US005228260A

United States Patent [19]

Dziedzic

[11] Patent Number: 5,228,260

[45] Date of Patent: Jul. 20, 1993

[54] CROSS BRACE AND SUPPORT ARM

[75] Inventor: Edward Dziedzic, Shelby, Tenn.

[73] Assignee: Aluma-Form, Inc., Memphis, Tenn.

[21] Appl. No.: 851,888

[22] Filed: Mar. 16, 1992

[51] Int. Cl.[5] ..... E04C 3/30

[52] U.S. Cl. ..... 52/697; 403/396; 403/400

[58] Field of Search ..... 52/40, 721, 697, 726; 403/391, 396, 400

[56] References Cited

U.S. PATENT DOCUMENTS

| | | | |
|---|---|---|---|
| 3,298,074 | 1/1967 | Kedem | 403/400 X |
| 3,861,816 | 1/1975 | Zaidan | 403/400 X |
| 4,272,208 | 6/1981 | Jones | 403/396 |
| 4,566,819 | 1/1986 | Johnston | 403/400 X |

*Primary Examiner*—Carl D. Friedman

*Assistant Examiner*—Creighton Smith

*Attorney, Agent, or Firm*—Paul M. Denk

[57] ABSTRACT

A crossarm assembly for installation on a utility pole includes a horizontally disposed cross arm. First and second box channels matingly interfit about the cross arm at a location generally equidistant the ends of the cross arm. The channels provide structural support for the cross arm to substantially reduce the amount of the deflection occurring at the end of the cross arm when the assembly is subjected to a load. A pole gain is integrated into an extrusion flange on one side of the box channels for attaching the channels to the pole and to add structural stability. The assembly includes attachment schackles by which conductor "dead ends" can be connected to the assembly when it serving as a "dead-end" assembly.

10 Claims, 4 Drawing Sheets

CROSS BRACE AND SUPPORT ARM

BACKGROUND OF THE INVENTION

This invention relates to electrical equipment mounts for use on a utility pole, and, more particularly to a "dead-end" cross arm assembly which increases the mechanical strength of a wooden section to which the assembly is attached while maintaining electrical characteristics relative to electrical break-downs known as "lightening flashover".

Assemblies for use in installing electrical equipment on electric utility poles is well known in the art. See for example, U.S. Pat. Nos. 4,596,105; 4,296,904; and 4,127,739, all to Farmer, which are assigned to the same assignee as the present application. The assemblies include crossarms that are load-bearing structures which, when mounted on a utility pole, support transformers and similar electrical equipment. There are various types of these assemblies, one of which is commonly referred to as a "dead-end" type cross arm. Recently there has been a need expressed by major utility users such as the United States Rural Electrification Administration for improved "dead-end" crossarms. Specifically, these users desire a cross arm in which the conventional underarm cross arm bracing is eliminated. Such an improved structural assembly would provide certain costs and installation advantages over conventional cross arms. But, certain problems must be overcome for any improved cross arm to be practical. For example, the cross beam must be able to provide significant restraint against vertical rotation at the point it is attached to the utility pole as well as substantial restraint for conductor pulling tensions where the conductor is terminated or "dead-ended.".

SUMMARY OF THE INVENTION

It is an object of the present invention to provide an electrical equipment mounting assembly for use on a utility pole, the assembly being a "dead-end" type cross beam assembly.

A further object of the invention is to provide a "dead-end" type cross beam assembly having improved load bearing characteristics and which, when installed on a utility pole, provides significant restraint against vertical pivot without the use of underarm cross arms.

Yet another object of the invention is to provide a "dead-end" arm that combines aluminum bracing and wood crossarm that allows the aluminum brace to absorb the high stress that occurs in all conventional cross arm arrangements under "dead-end" conductor tensions.

Still another object of the invention is to provide a crossarm device that combines a metal, for example, aluminum, with wood to give the wood a synergistic increase in apparent fiber strength.

A still further object of the invention is to provide a crossbeam assembly of a non-electrically conducting metallic material which is sized and shaped to provide an optimal combination of strength and resistance to deflection under load.

Yet another object of the invention is to provide a cross arm assembly which permits "down guys" to be attached to the assembly in proximity to the center of any structural loads mounted thereon thereby reducing or eliminating bending stresses.

Another object of the invention is to provide an improved crossarm assembly having required electrical characteristics with respect to electrical break-down and "lightening flashover".

A still further object of the invention is to provide an improved crossarm assembly which is simple in design, readily fabricated, and easy to install in the field.

In accordance with the invention, generally stated, this development relates to a crossarm assembly for installation on a utility pole. The assembly includes a horizontally disposed crossarm. First and second box channels matingly interfit about the crossarm at a location generally equidistant the ends of the crossarm. The box channel assembly provides structural support for the crossarm to substantially reduce the amount of deflection occurring at the end of the crossarm when the assembly is subjected to a load. A mounting gain is provided for attaching the channels to the pole. The mounting gain is integrally attached to the channels to enhance structural stability. The assembly contains attachment means by which conductors can be connected to the assembly when it is serving a "dead-end" assembly.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENT

Figure 1:
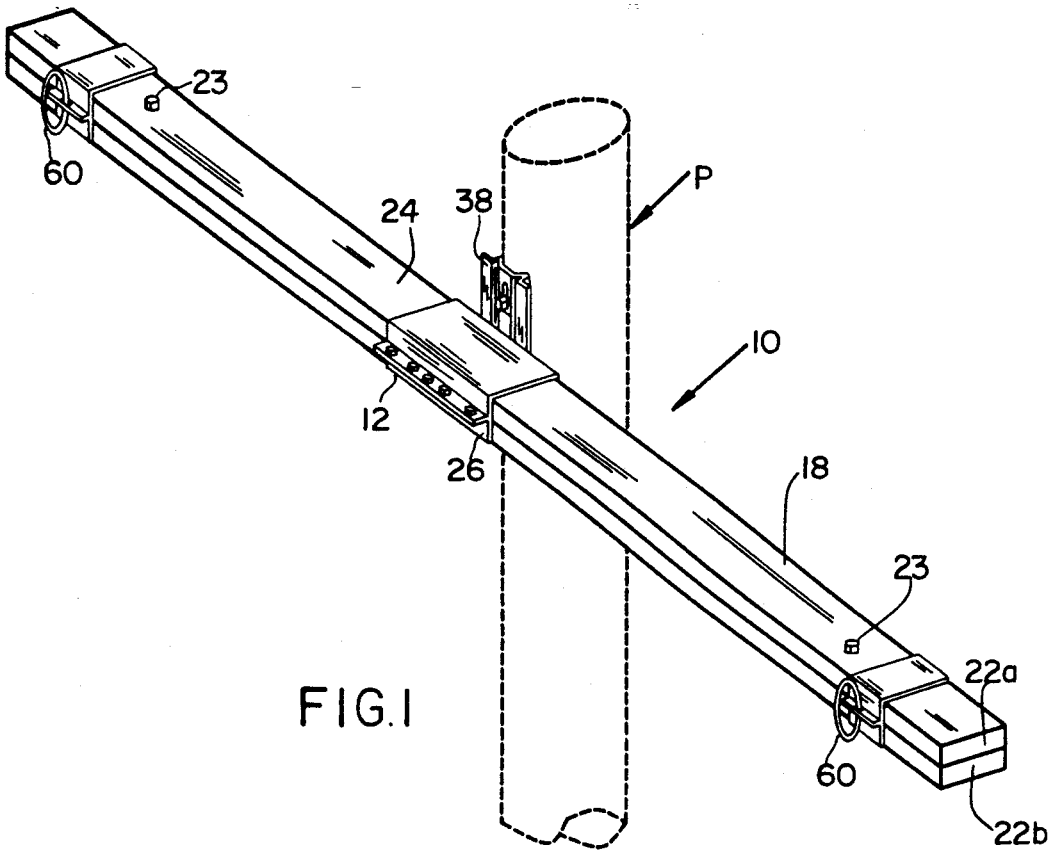
FIG. 1 is an isometric view of the cross beam assembly of the present invention, the telephone pole shown in phantom for perspective.

Referring to the drawings, and particularly FIG. 1, a cross beam assembly of the present invention is indicated generally at 10. The assembly is for installation on a utility pole P.

Figure 2:
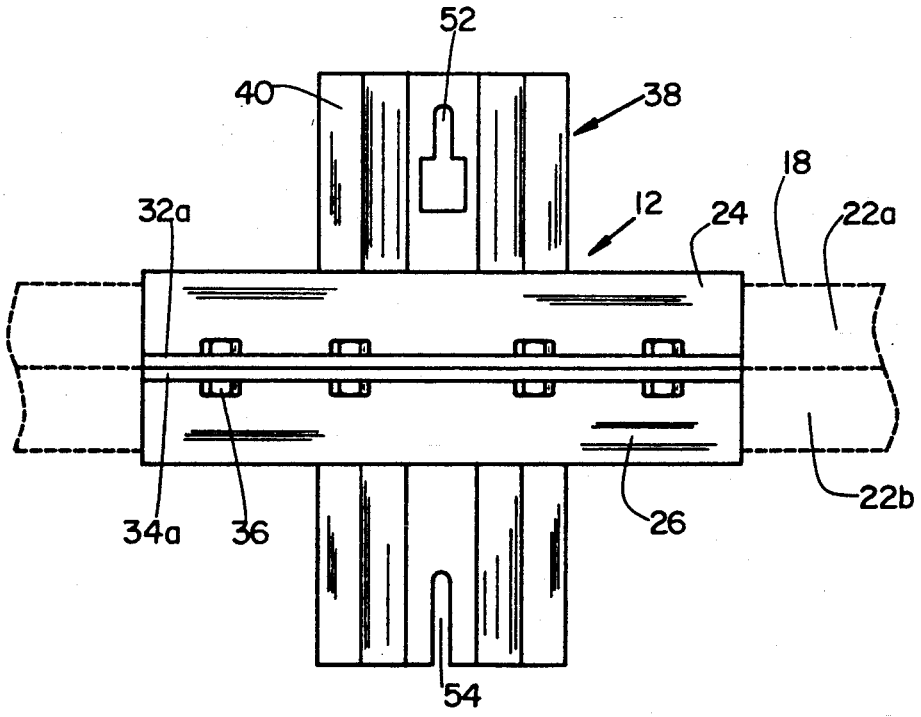
FIG. 2 is a front elevational view of the crossarm assembly of the present invention.
Figure 3:
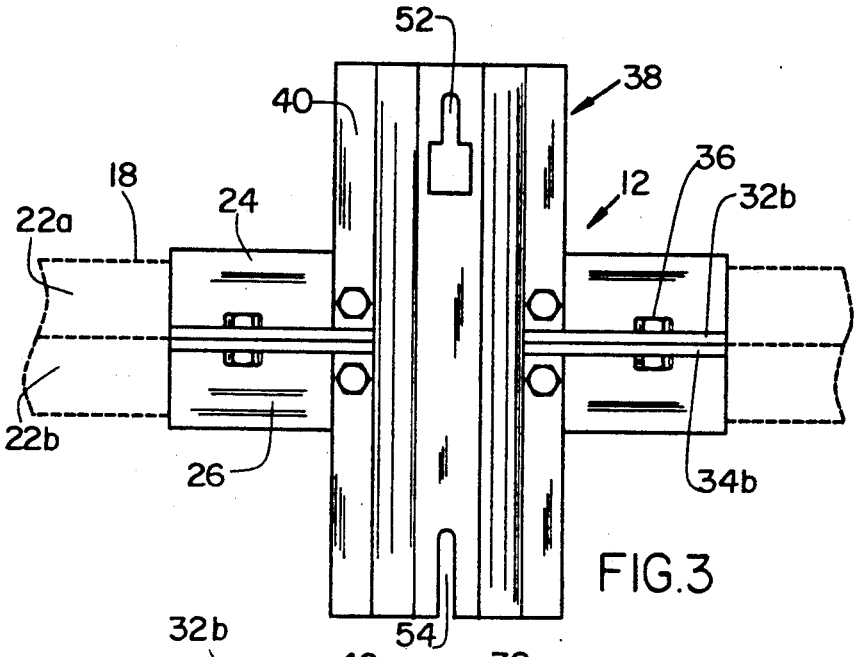
FIG. 3 is a rear elevational view of the crossarm assembly of the present invention.

Assembly 10 includes a brace assembly 12 and horizontally disposed crossarm as shown in FIG. 1. The crossarm 18 can be comprised of either a unitary member (not shown), or it may be comprised of two or more members *22a, 22b* arranged in a face-to-face abutting arrangement as shown in FIGS. 1–3. In either embodiment, cross beam 18 is a wooden beams. If two beams are used, they are arranged in a vertically stacked configuration and may be attached to each other by a vertically extending bolt 23 (see FIG. 1).

Figure 6:
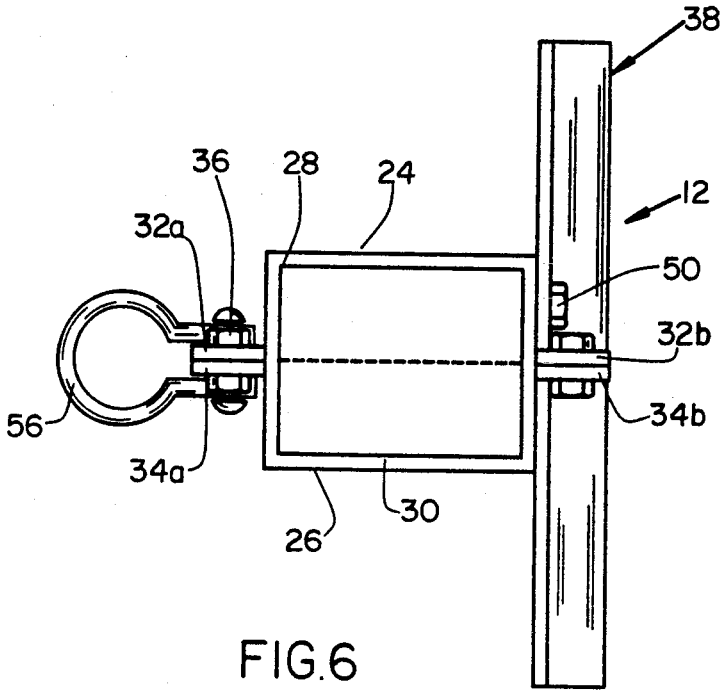
FIG. 6 is an end view of the crossarm assembly.

Brace assembly 12 includes first and second channel means 24 and 26 respectively. Each channel means includes a box channel 28, 30 respectively (see FIG. 6) matingly interfitting about crossarm 18. Box channels 28 are fitted about crossarm 18 at its midpoint so as to be equidistant the ends of crossarm 18. When installed, the box channels provide structural support for crossarm 18 to substantially reduce the amount of deflection occurring at an end of crossarm 18 when assembly 10 is subjected to a load (see FIG. 7).

Channels 24 and 26 are each of the same general size and shape and are generally formed from a strong, lightweight metal with appropriate elastic characteristics such as aluminum or aluminum alloy. Each box channel 28 and 30 have channel dimensions corresponding to the thickness of cross beam 18, for box channels 28 and 30 to fit over cross beam 18 and over ½ the width of cross beam 18.

Each box channel has respective mating flanges (32*a*, 32*b* for channel 28, and 34*a* and 34*b* for channel 30) extending outwardly from the side of the channels. As shown therein, flange 32*a* abuts flange 34*a* when the box channels are installed, as does flange 32*b* abut flange 34*b*. The abutting flanges are attached to each other by bolts 36. It will be noted that the respective mating surfaces of box channels 28 and 30 are orthogonal to the abutting faces of crossarm 18 to increase overall bending strength of the assembly against conductor "dead-end" tensions.

Figure 4:
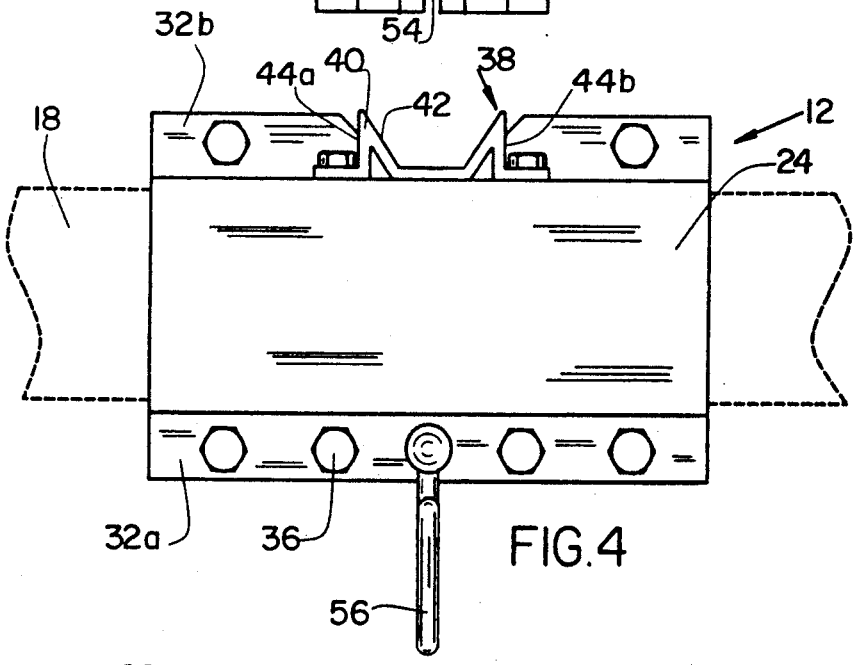
FIGS. 4–5 are respective top and bottom plans of the crossarm assembly of the present invention.
Figure 5:
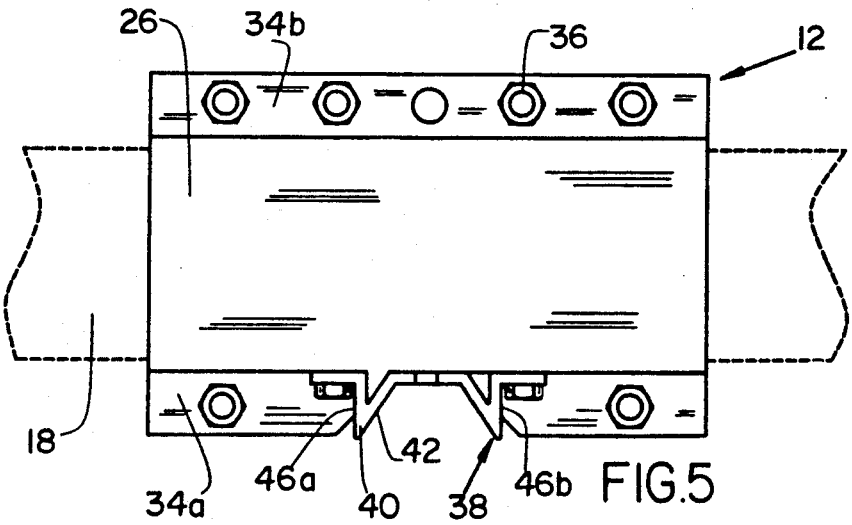
Figure 8:
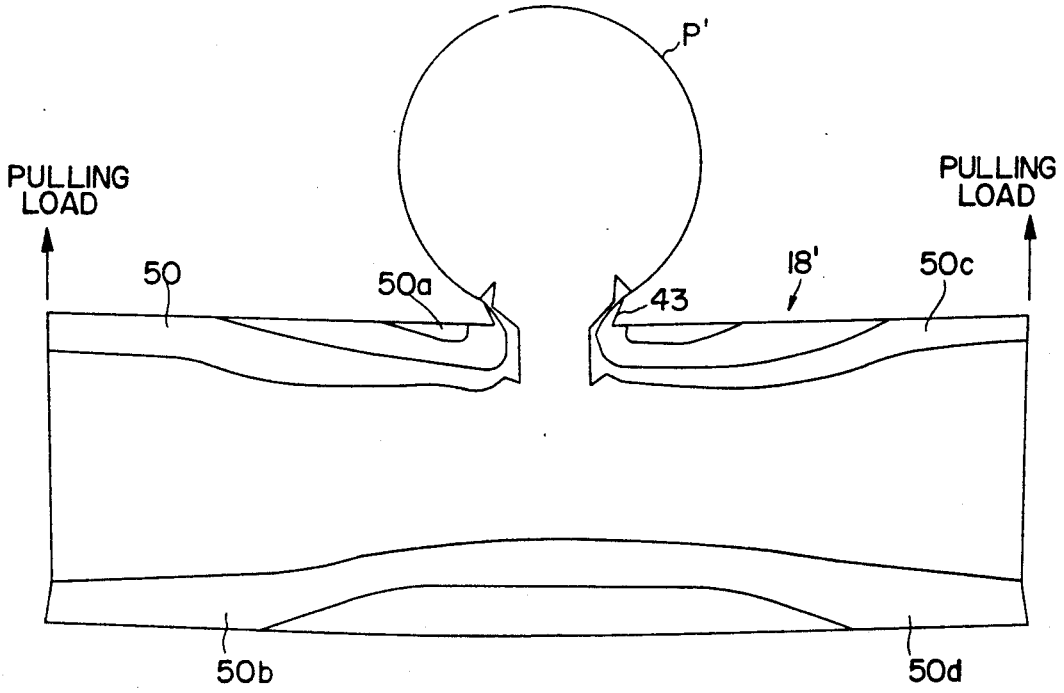
FIG. 8 is a schematic, top plan view of a crossarm assembly employing a pole gain of the prior art demonstrating stress disbursement through the wooden crossarm.
Figure 9:
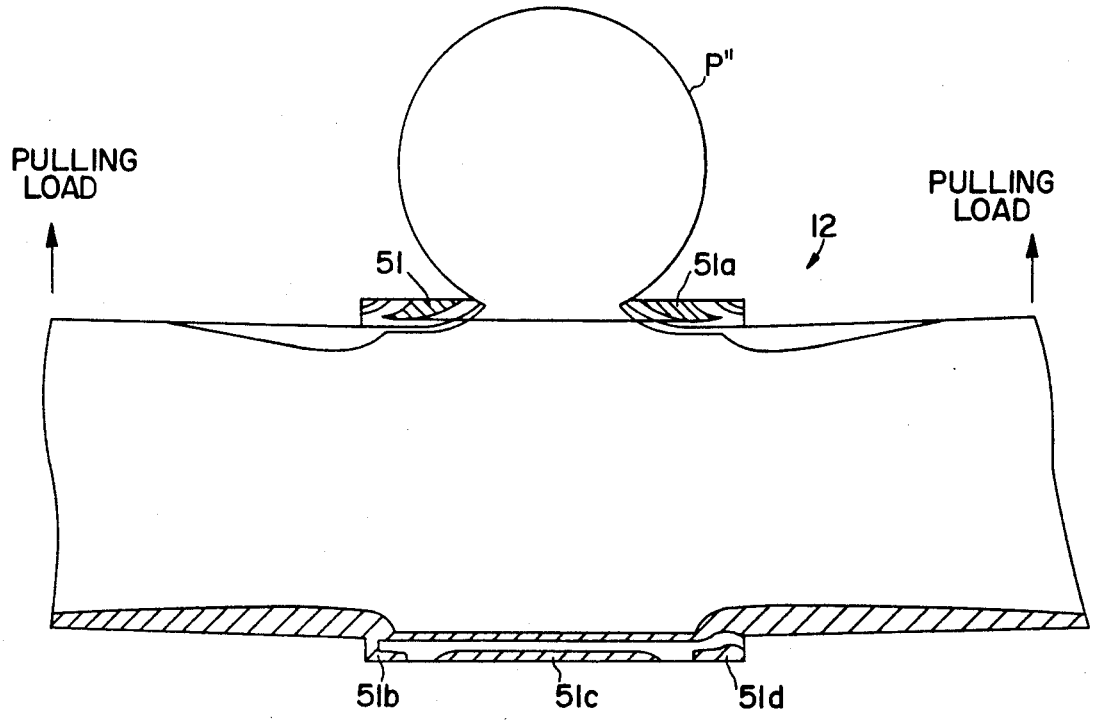
FIG. 9 is a schematic, top plan view of a crossarm assembly employing the brace assembly of the present invention illustrating the absorption of stress principally by the brace assembly.

Assembly 10 includes means 38 for attaching the assembly to a utility pole. Means 38 includes a pole gain 40 having an outer, arcuate base 42 which rests against the curved surface of the utility pole (see FIGS. 4 and 5). The height of pole gain 40 is greater than that of the channel assembly for gain 40 to extend above and below the upper and lower surfaces of the assembled box channels. Gain 40 is integrated into flanges 32*a* and 34*a* at points 44*a* and 44*b* and at points 46*a* and 46*b* respectively so as to increase rigidity and strength. FIGS. 8 and 9 illustrate the effect of the integrated pole gain assembly on spreading stress. FIG. 8 illustrates stress transfer through crossarm 18' attached to pole P' with a pole gain 43 known to the art. Stress areas 50–50*d* are transferred through cross beam 18 and can result in cross beam failure. FIG. 9 illustrates stress transfer using brace assembly 12 of the present invention. Gain 40 is mounted to pole P", and stress areas 51–51*d* are primarily confined to the area of flanges 32*a* and 32*b* as well as 34*a* and 34*b* (not shown) of assembly 12 to prevent crossarm failure until much higher "dead-end" tensions occur on the conductors.

The addition of brace assembly 12 to cross member 18 increases the strength of assemblies 10 synergistically relative to the strength of wood alone as shown in the following graph.

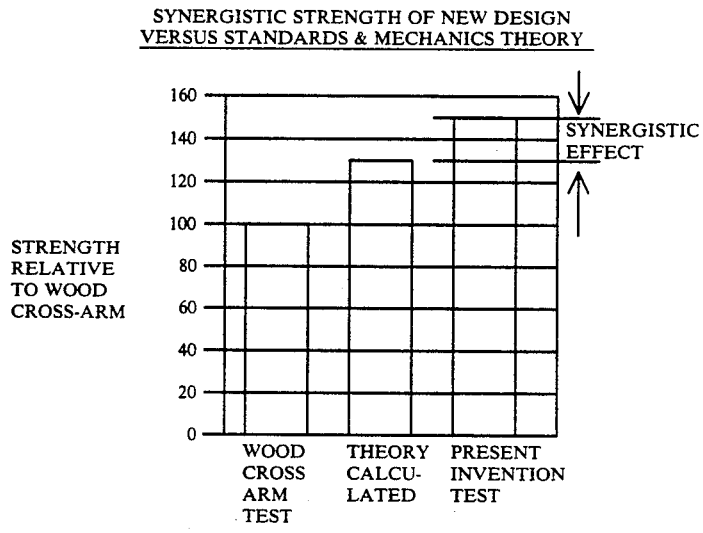

The graph illustrates the strength of a wood crossarm under stress at bar 1. Bar 2 illustrates the calculated relative strength of the present invention relative to wood alone. Bar 3 illustrates the actual relative strength of the assembly of the present invention. As can be seen, the combination of brace assembly 12 and wood cross beam has an actual strength that exceeds the calculated strength under calculated mechanic theory. This demonstrates that the combination of brace 12 on cross beam 18 acts synergistically to exceed the expected test strength.

Figure 7:
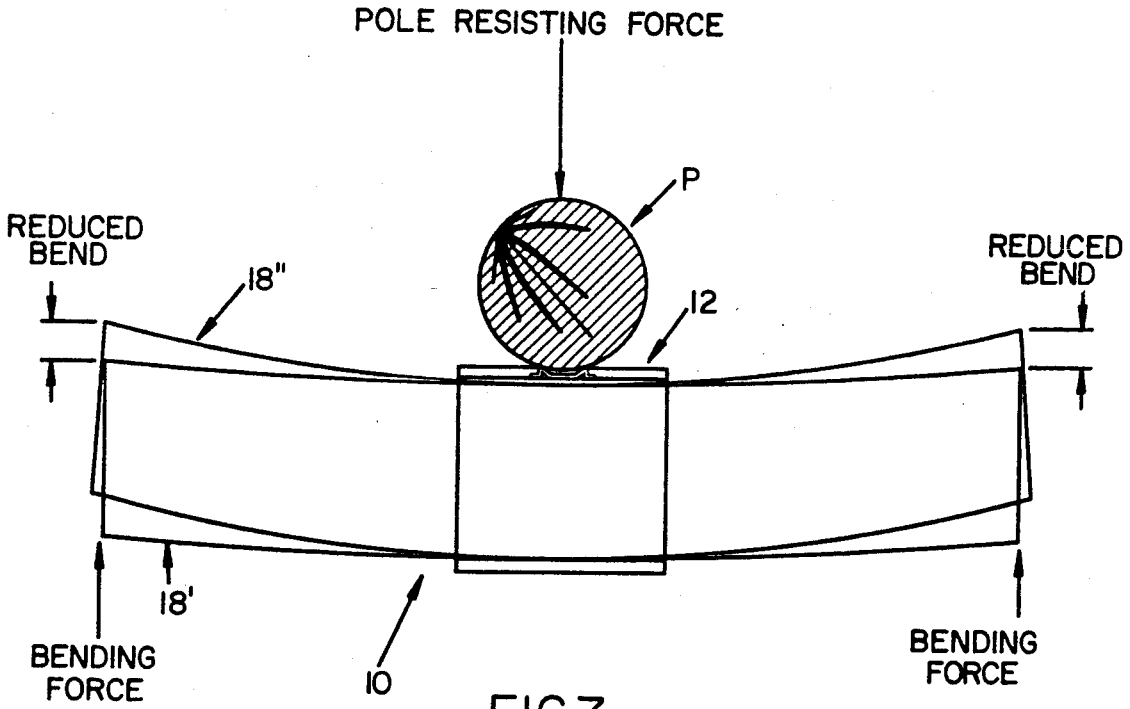
FIG. 7 is a top plan of a crossarm assembly employing the present invention in schematic illustrating the reduced beam bending characteristics therein.

FIG. 7 also illustrates the reduced bending of assembly 10 employing brace assembly 12 on wooden crossarm 18. Crossarm 18' illustrates the bending of assembly 10 employing brace 12. Cross arm 18" illustrates the relative movement under bending force of a crossarm mounted to pole P using prior art pole gains. As can be seen in FIG. 7, there is a substantial reduction in crossarm bend in the assembly employing the present invention.

Pole gain 38 is attached to box channel assembly with bolts 50. When installed, gain 40 is rigidily secured to the remainder of assembly 12, being integrated into flanges 32*b* and 34*b* abutting flanges 32*a* and 32*b* at points 44*a* and 44*b*, 46*a* and 46*b* respectively thereby increasing the overall strength of assembly 12.

The completed assembly 10 is installed on a utility pole P in any conventional manner well known in the art. For example, bolts (not shown) can be secured to pole P and assembly 12 can be mounted by positioning slots 52 and 54 under the head of the bolt. This method of mounting is described for illustrative purposes only.

The unique box channel configuration provides sufficient structural strength that assembly 12 is a stronger support than any conventional assembly.

Assembly 10 is also designed to function as a "dead-end" crossarm assembly; that is, it is installable on the last or end pole of a series of utility poles or where conductors are terminated at high tension pulls. For this usage, assembly 10 can include rings called shackles 56 and 60 (see FIGS. 1 and 4) for attaching conductor terminations. Shackle ring 56 is located at the mid-point of box channel assembly 12, so a conductor termination (not shown), when connected to shackle 56, will exert a force at the center of the full/crossarm assembly structure.

In addition to shackle 56, other shackles 60 may be located at the respective ends of cross beams 18. Shackles 60 are mounted to bracket 66 which are sized to accommodate the height of cross member 18. Thus, four or eight additional shackles usually are attached to the assembly, depending upon the number of conductor "dead-ends."

In view of the foregoing, it will be seen that the several objects of the invention are achieved and other advantageous results are obtained.

As various changes could be made in the above construction without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. A crossarm assembly for installation on a utility pole comprising, a horizontally disposed crossarm, first and second channel means matingly interfitting about the crossarm at a location generally equidistant the ends of the crossarm, the channel means providing structural support for the crossarm to substantially reduce the amount of the deflection occurring at an end of the crossarm when the assembly is subjected to a load, means for attaching the channel means to the pole, the means for attaching the assembly to the pole including a gain attachable the channel means, and being arranged at a perpendicular with respect to the channel means, the channel means each comprises a box channel of generally the same size and shape, the box channel having respective mating surfaces at the opposite sides of the channel, the mating surfaces comprise respective extrusion flanges extending horizontally outwardly from the sides of the channel, wherein the assembly further includes means for attaching the flanges together, the box channels being fitted about the crossarm so their mating flanges are horizontally oriented, the flanges of the box channels arranged contiguously with the gain being cut away to provide clearance for attachment of the gain directly to the back side of the box channels, whereby the arrangement of the flanges of the box channel substantially horizontally aligned at the front and the back of the crossarm providing for reduction in the stress generated within the crossarm during its application upon a utility pole.

2. The assembly of claim 1 wherein the crossarm comprises a member substantially rectangular in cross section.

3. The assembly of claim 2 wherein the crossarm is comprises of two members arranged in face-to-face abutting arrangement.

4. The assembly of claim 3 wherein the members are wooden members.

5. The assembly of claim 1 wherein the gain is integrally attached to the extrusion flanges extending outwardly from the side of the channel at a point generally equidistant from each end of the flange.

6. The assembly of claim 5 wherein each side of the gain vertically abuts the cut out extrusion flanges providing further structural support.

7. A crossarm assembly for installation on a utility pole comprising, a horizontally disposed crossarm, first and second channel means matingly interfitting about the crossarm at a location generally equidistant the ends of the crossarm, the channel means providing structural support for the crossarm to substantially reduce the amount of deflection occurring at an end of the crossarm when the assembly is subjected to a load, means for attaching the channel means to the pole, said crossarm comprising a member substantially rectangular in cross section, said crossarm comprising two members arranged in face-to-face abutting arrangement, the channel means each comprising a box channel of generally the same size and shape, the box channel having respective mating surfaces at the opposite sides of the channel, the junction formed by the respective mating surfaces of the channels is orthogonal to the junction formed by the abutting faces of the crossarm member, the means for attaching the assembly to the pole includes a gain attachable to the box channels, and means for attaching conductor "dead-ends" to the assembly.

8. The assembly of claim 7 wherein the attaching means includes a shackle mounted on the face of the box channels opposite the pole, when the assembly is attached thereto, one end of a conductor attachable to the ring.

9. The assembly of claim 8 further including additional end shackles attached to the outer ends of the crossarm members adjacent to the corners thereof, the end shackles facilitating attachment of the conductor "dead-ends" to the assembly.

10. The assembly of claim 8 wherein each end ring includes a C-shaped mounting bracket installable over the crossarm members for mounting the shackles thereon.

* * * * *